US011835063B1

(12) United States Patent
Davidenko

(10) Patent No.: US 11,835,063 B1
(45) Date of Patent: Dec. 5, 2023

(54) QUICK ATTACHMENT FOR FAN ACCESSORIES

(71) Applicant: DELTA T, LLC, Lexington, KY (US)

(72) Inventor: Igor Davidenko, Lexington, KY (US)

(73) Assignee: DELTA T, LLC, Lexington, KY (US)

( * ) Notice: Subject to any disclaimer, the term of this patent is extended or adjusted under 35 U.S.C. 154(b) by 0 days.

(21) Appl. No.: 16/907,651

(22) Filed: Jun. 22, 2020

Related U.S. Application Data

(60) Provisional application No. 62/864,152, filed on Jun. 20, 2019.

(51) Int. Cl.
*F04D 25/08* (2006.01)
*F04D 29/60* (2006.01)
*F04D 29/66* (2006.01)

(52) U.S. Cl.
CPC ..... *F04D 29/601* (2013.01); *F04D 25/088* (2013.01); *F04D 29/668* (2013.01)

(58) Field of Classification Search
CPC ..... F04D 25/088; F04D 29/601; F04D 29/668
See application file for complete search history.

(56) References Cited

U.S. PATENT DOCUMENTS 5,069,601 A * 12/1991 Shawcross ..... F04D 25/088 417/360
5,507,619 A * 4/1996 Ryan ..... F04D 25/088 416/244 R
6,398,179 B1 * 6/2002 Soles ..... B60G 11/28 248/222.51
6,682,303 B2 * 1/2004 Wu ..... F04D 25/088 362/147
6,699,014 B1 * 3/2004 Lam ..... F04D 29/34 416/220 A
6,780,049 B1 * 8/2004 D'Angelo ..... F04D 29/601 439/313
7,249,744 B2 * 7/2007 Bacon ..... F04D 25/088 248/343
8,025,528 B2 * 9/2011 Smith ..... F16M 11/041 439/537
8,042,961 B2 * 10/2011 Massara ..... H04R 1/028 362/86
8,231,403 B2 * 7/2012 Smith ..... H01R 13/625 439/529
8,770,949 B2 * 7/2014 Noble ..... F04D 25/068 417/410.1
9,344,787 B2 * 5/2016 Berkman ..... H04R 1/028
9,712,015 B2 * 7/2017 Yin ..... F16C 35/063
10,476,276 B2 * 11/2019 Amelio ..... H02J 50/20
10,641,291 B2 * 5/2020 Jones ..... F04D 25/0693
(Continued)

*Primary Examiner* — Michael L Sehn
(74) *Attorney, Agent, or Firm* — Dickinson Wright PLLC; Andrew D. Dorisio

(57) ABSTRACT

An apparatus includes a ceiling fan and an accessory. A receiver is adapted to attach to the ceiling fan, and an adaptor for the accessory is provided. The adaptor is adapted to releasably attach to the receiver and fix the accessory in position with respect to the ceiling fan. A dampener may be provided, and receiver may include at least one projection adapted to engage the dampener, thereby inhibiting vibration of the accessory during operation of the ceiling fan. The accessory may also include a gasket, and the receiver may include at least one projection adapted to engage the gasket, thereby at least partially sealing a motor from an environment external to the ceiling fan.

15 Claims, 11 Drawing Sheets

(56) References Cited

U.S. PATENT DOCUMENTS

| | | | | |
|---|---|---|---|---|
| 2009/0280673 | A1* | 11/2009 | Kohen | F21V 23/06 439/366 |
| 2012/0305731 | A1* | 12/2012 | Yearsley | F21S 8/04 248/329 |
| 2015/0090858 | A1* | 4/2015 | Broughman | F04D 29/601 248/674 |
| 2019/0264702 | A1* | 8/2019 | Huggins | F21V 33/0096 |

* cited by examiner

QUICK ATTACHMENT FOR FAN ACCESSORIES

This application claims the benefit of U.S. Provisional Patent Application Ser. No. 62/864,152, filed Jun. 20, 2019, the disclosure of which is incorporated herein by reference.

TECHNICAL FIELD

This document relates generally to the assembly of ceiling fans and, more particularly, to a system for attaching an accessory to a ceiling fan.

BACKGROUND

Ceiling fans may attach with various accessories, such as decorative covers, lights, speakers, communication devices, signaling devices, alarms, sensors, or the like. These accessories are typically mechanically attached to a downtube with external threads that runs down the center of the fan. However, this type of attachment system requires a special design, multiple tools to assemble, and thus is expensive and cumbersome to implement in some cases.

Readily available accessory attachments for fans often suffer from a lack of security for the supported accessories. Consequently, when the fan is in use, accessories which have been attached to the fan may rattle undesirably. Furthermore, the insecurity of the accessories can lead to the attachment becoming detached, pinched or caught in other components. This is especially true when the ceiling fan is mounted in a hostile or outdoor environment and exposed to turbulence. or other harsh conditions.

Accordingly, there is a need for an accessory attachment system that can withstand such environments, as may be in the case of outdoor fans mounted in or near coastal regions, or even in a factory or like environment with extreme conditions. In addition, a need is identified for a quick and easy ceiling fan accessory attachment system that do not require extensive use of tools for assembly.

SUMMARY

According to one aspect of the disclosure, an apparatus includes a ceiling fan, an accessory, and a receiver adapted to attach to the ceiling fan. An adaptor is provided for the accessory. The adaptor is adapted to releasably attach to the receiver and fix the accessory in position with respect to the ceiling fan.

In one embodiment, the adaptor is adapted to mate with the receiver via a rotational movement of the accessory. The receiver may include at least one projection, and the adaptor comprises at least one receiver for receiving the projection. A detent may be provided to lock the accessory in position with respect to the receiver. The detent may comprise a spring pin, and further including a boss adapted to allow movement of the spring pin in a first direction to a first position and to prevent movement of the spring pin in a second direction beyond the first position.

The accessory may comprise an electrically functional element. A coiled electrical harness may also be provided for connecting the accessory to the ceiling fan. The accessory may include a dampener, and the receiver may include at least one projection adapted to engage the dampener, thereby inhibiting vibration of the accessory during operation of the ceiling fan.

According to a further aspect of the disclosure, an apparatus comprises a ceiling fan, an accessory, and a dampener. A receiver is adapted to receive the accessory and connect with the ceiling fan. The receiver includes at least one projection adapted to engage the dampener, thereby inhibiting vibration of the accessory during operation of the ceiling fan.

In one embodiment, the dampener is connected to the accessory, which may comprise an electrically functional element. For example, the electrically functional element may be selected from the group consisting of a speaker, a sensor, and a camera. A coiled electrical harness may also be provided for connecting the accessory to the ceiling fan. A detent is adapted to lock the accessory in position with respect to the ceiling fan. The detent may comprise a spring pin, and further including a boss adapted to allow movement of the spring pin in a first direction to a first position and to prevent movement of the spring pin in a second direction beyond the first position.

According to another aspect of the disclosure, an apparatus includes a ceiling fan with a motor and an accessory including a gasket. A receiver is adapted to receive the accessory and at least one projection adapted to engage the gasket, thereby at least partially sealing the motor from an environment external to the ceiling fan.

In one embodiment, the gasket and the at least one projection form a perimeter seal around at least a portion of the motor. The accessory may comprise an electrically functional element. For example, the electrically functional element is selected from the group consisting of a speaker, a sensor, and a camera. The accessory may further include a coiled electrical harness adapted to connect to the ceiling fan.

BRIEF DESCRIPTION OF THE DRAWING FIGURES

The above and further advantages of the disclosure may be better understood by referring to the following description in conjunction with the accompanying drawings in which.

Figure 3:
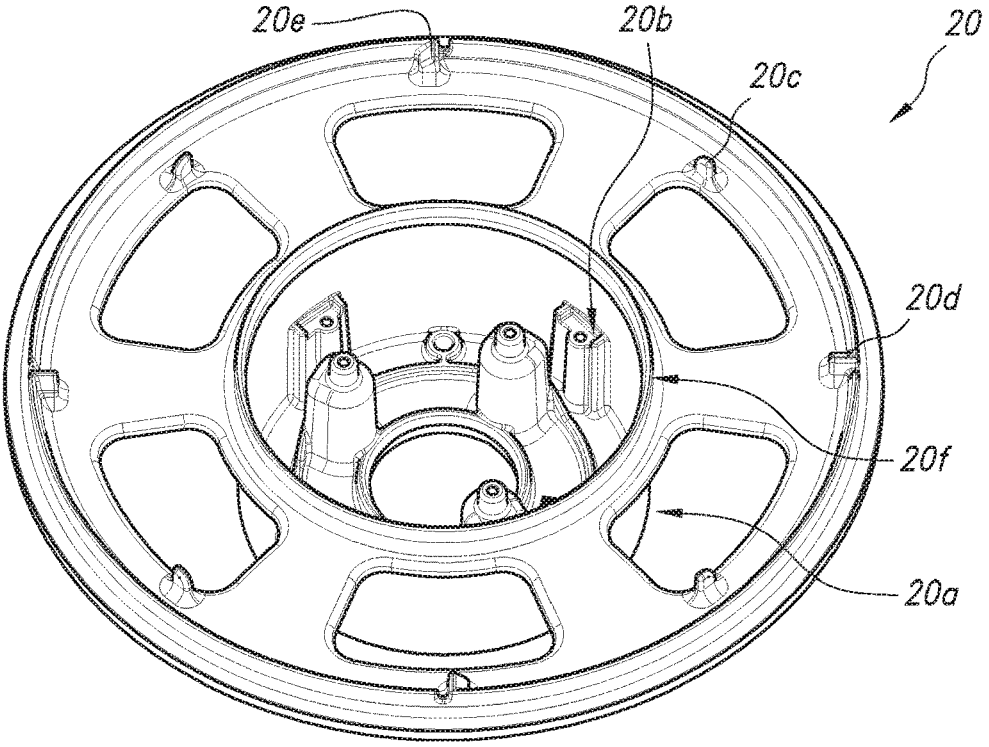

FIG. 3 provides a view of a component of the mounting system.

Figure 4:
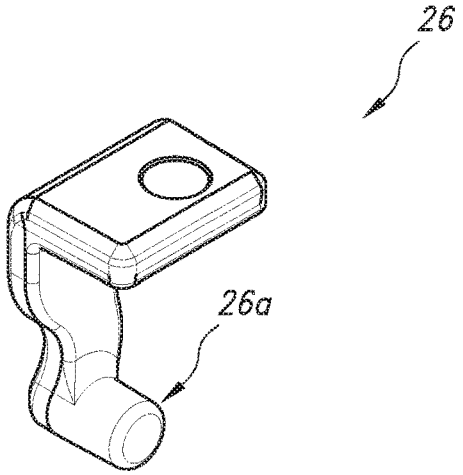

FIG. 4 provides a views of another component of the mounting system.

Figure 5:
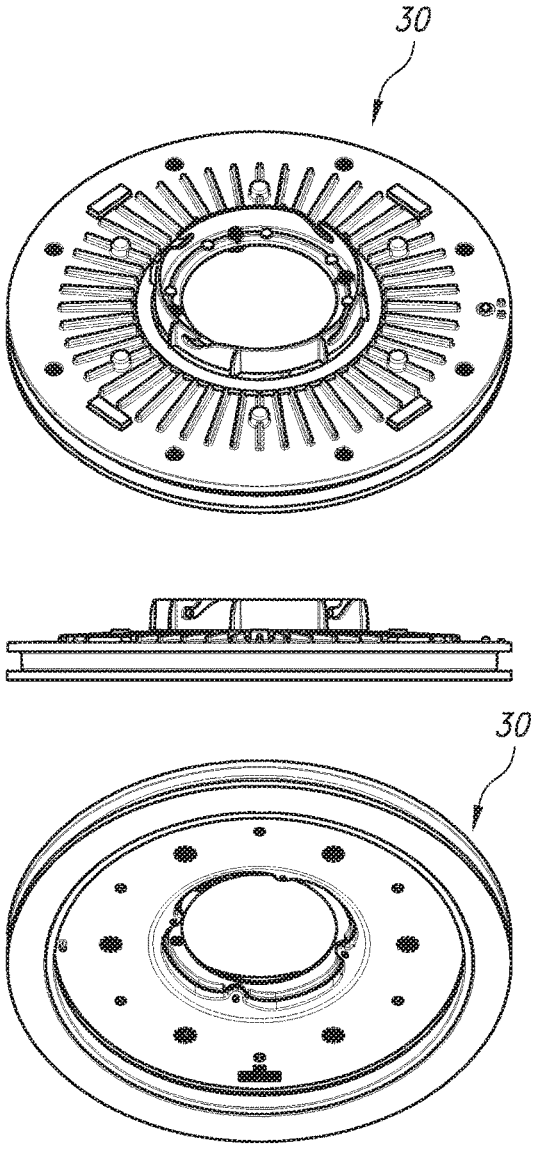
Figure 5A:
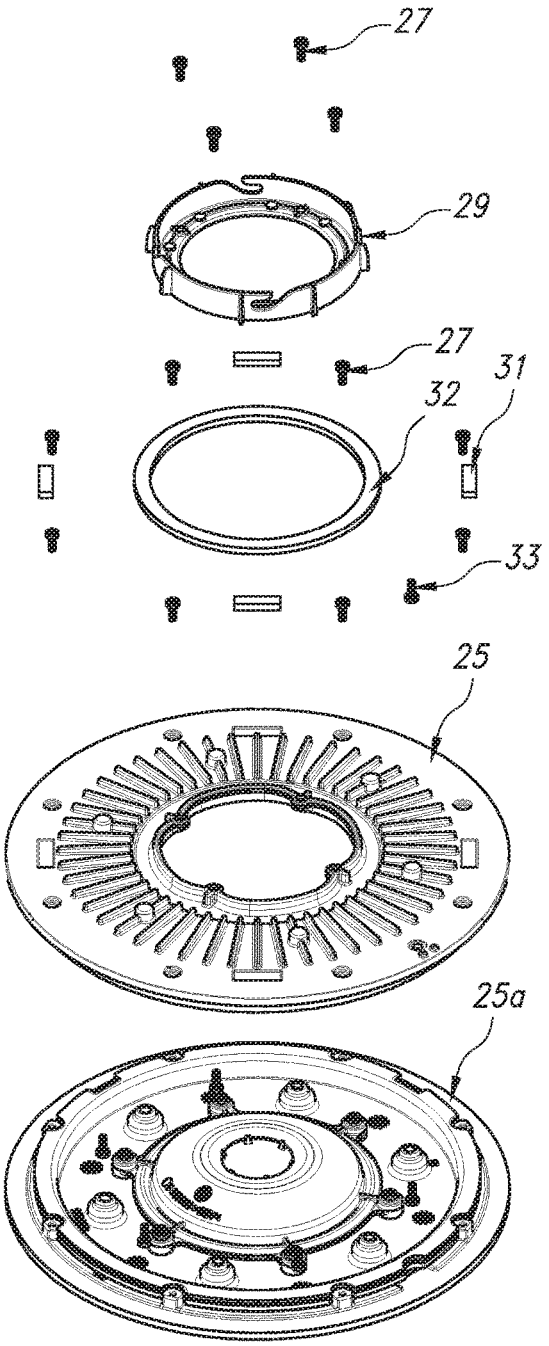

FIGS. 5 and 5A are views of an accessory according to one embodiment.

Figure 6:
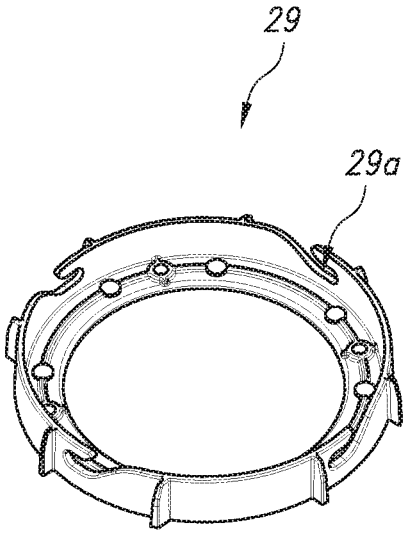
Figure 7:
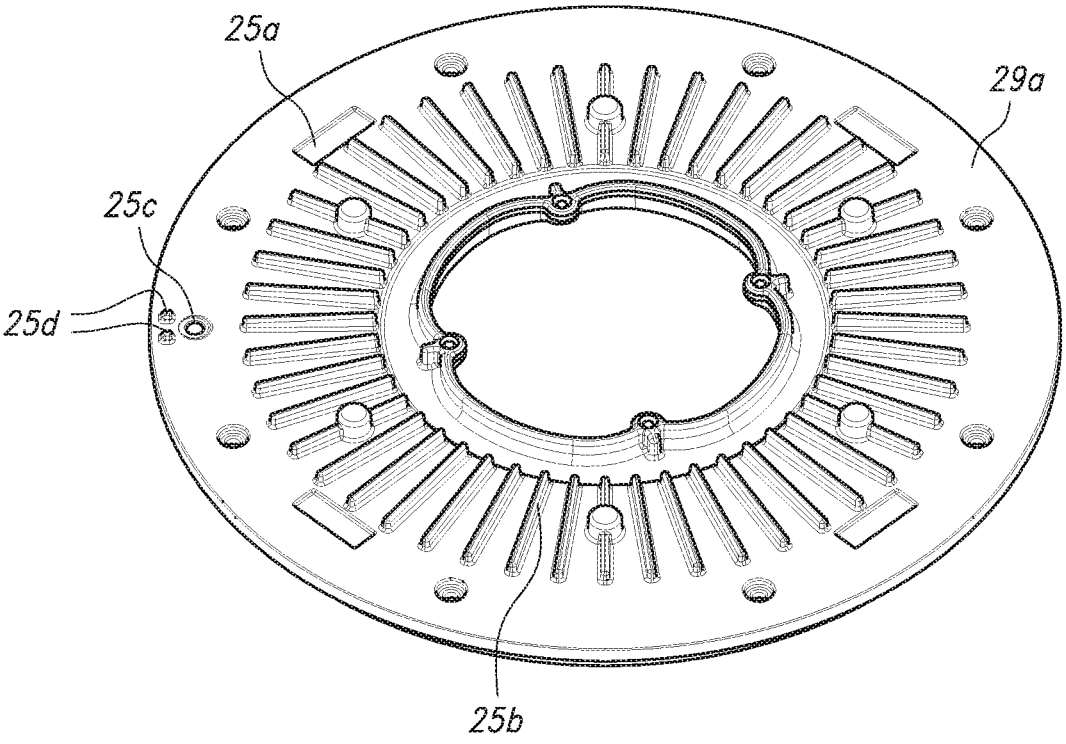

FIGS. 6 and 7 illustrate components of the accessory.

Figure 8:
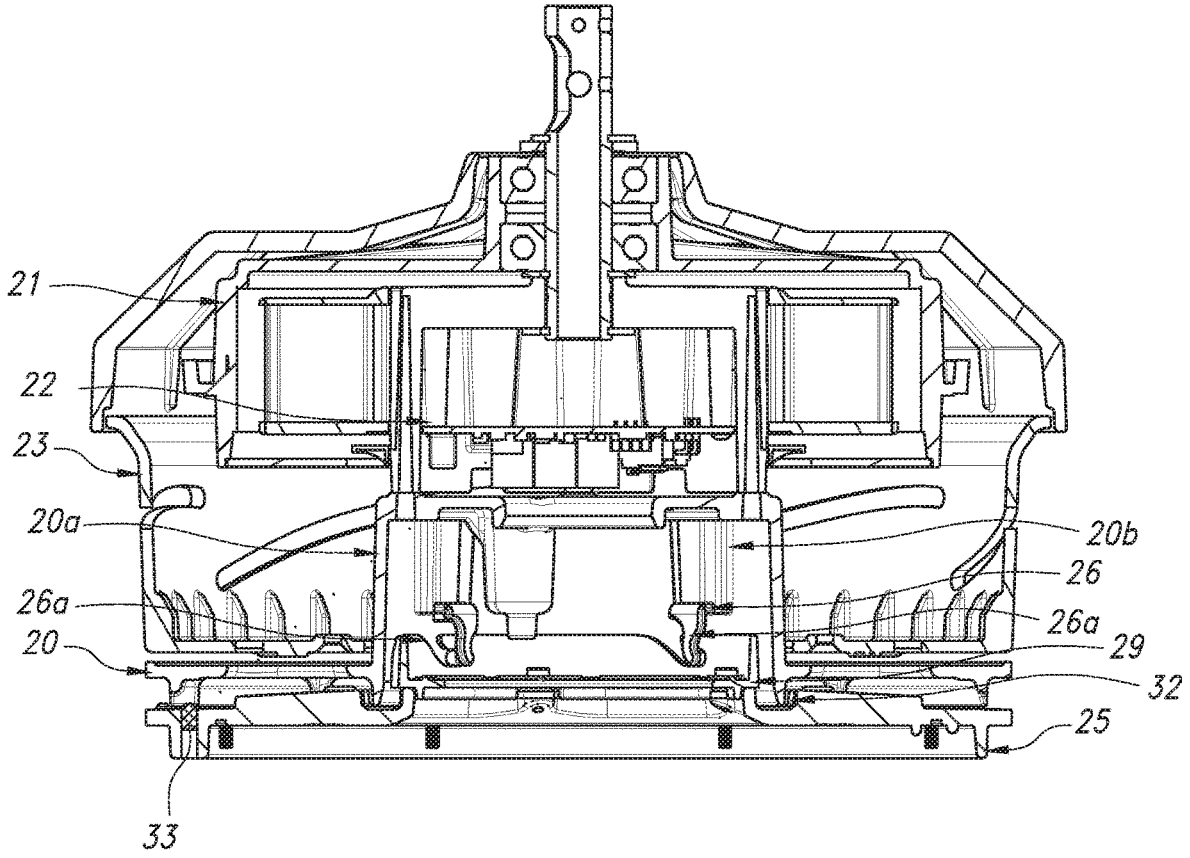
Figures 1, 8A:
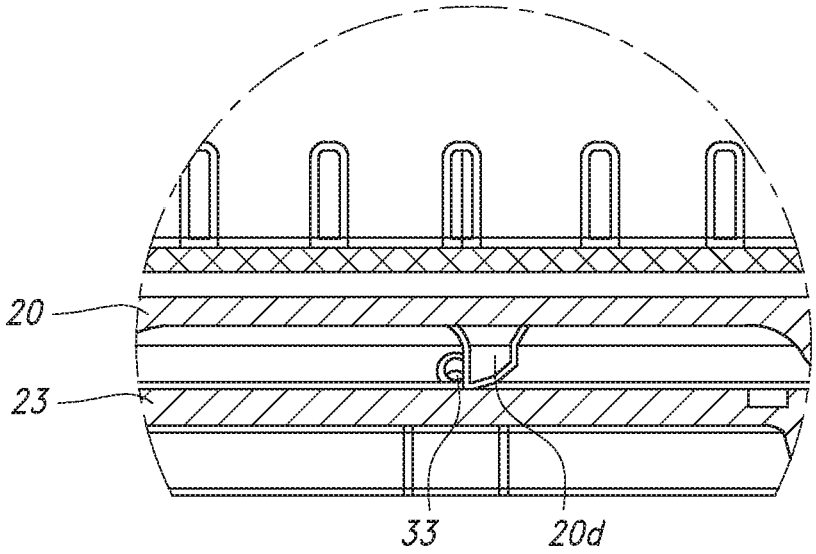
Figures 2, 8A:
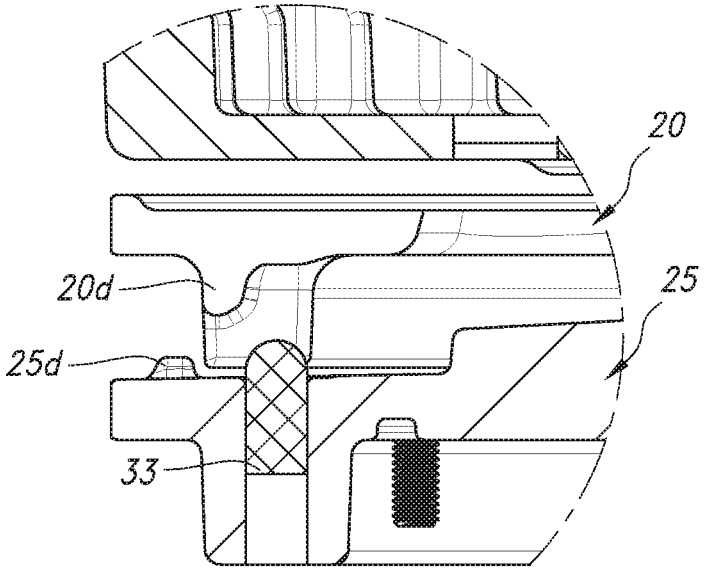

FIGS. 8 and 8A are full and partial cross-sectional views of a portion of the fan including the accessory.

Figure 9:
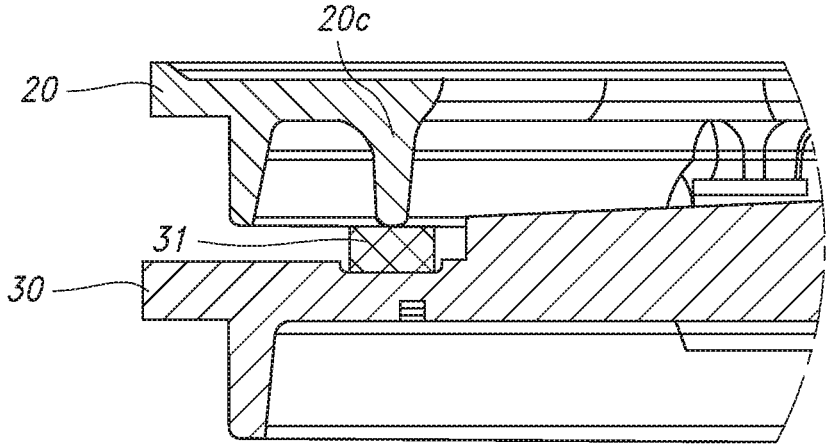

FIG. 9 is another partial cross-sectional view of a portion of the accessory.

Figure 10:
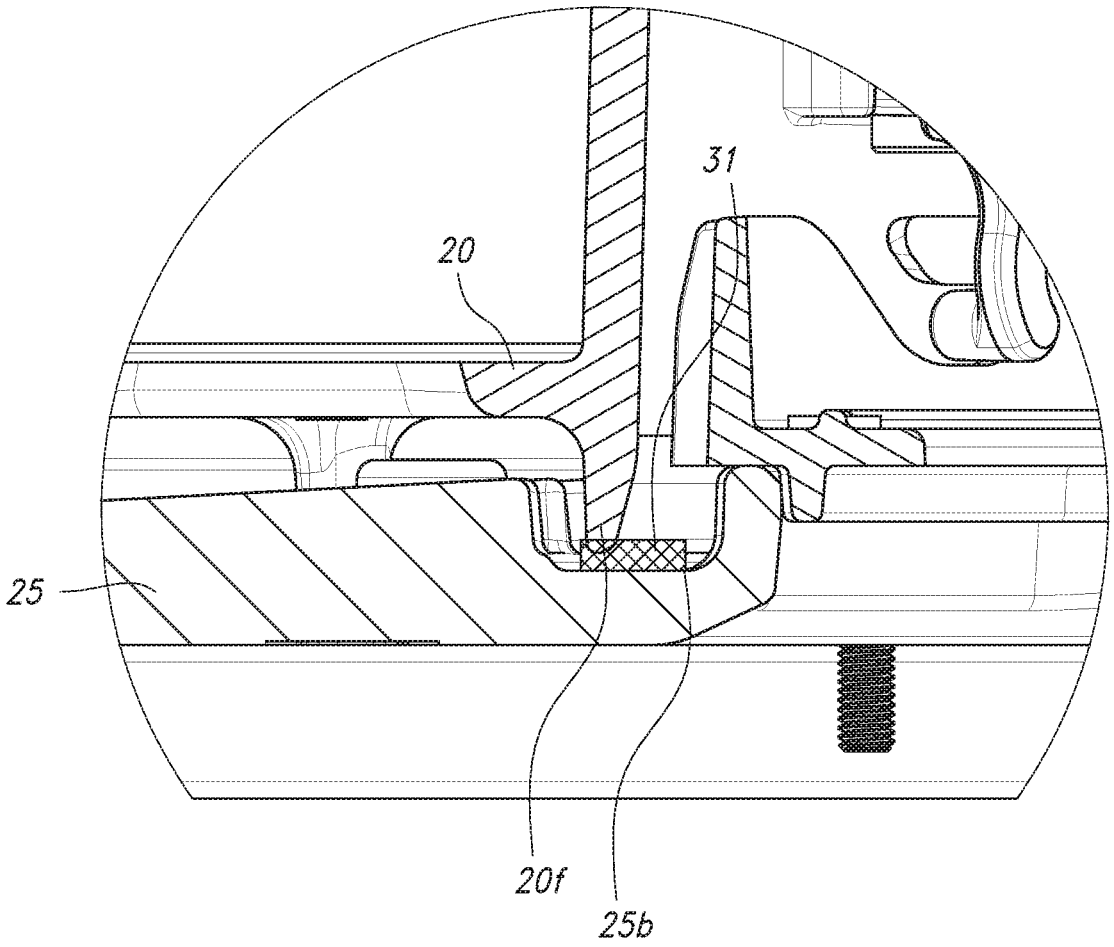

FIG. 10 is another partial cross-sectional view illustrating another aspect of the disclosure.

Figure 11:
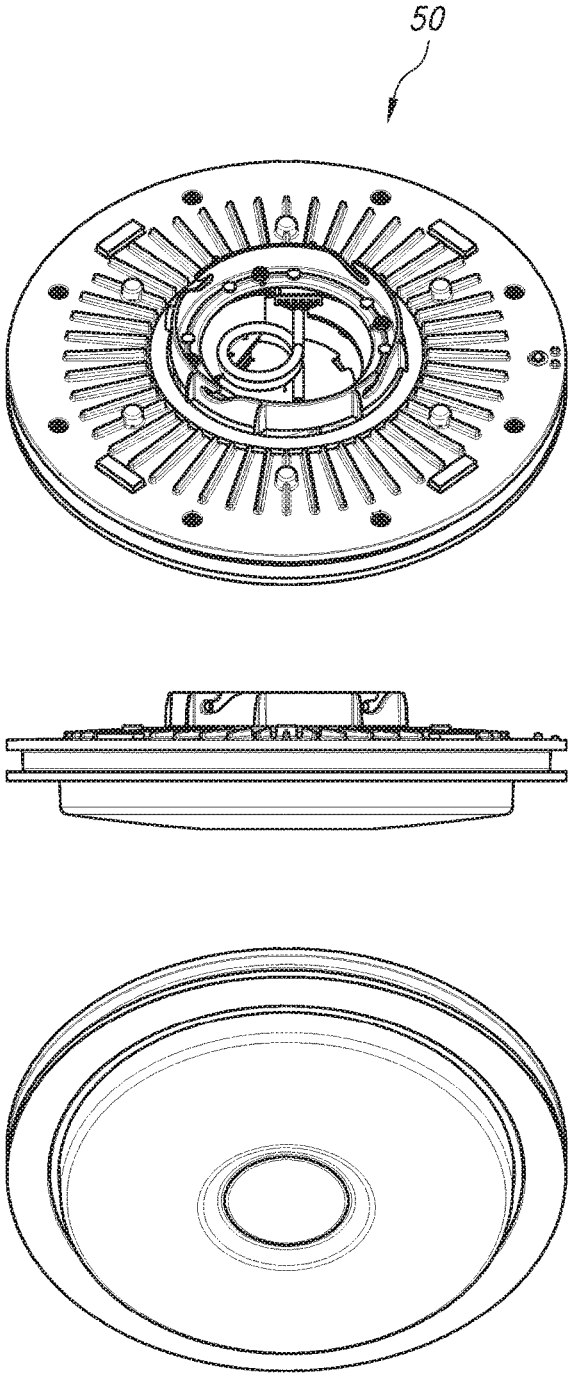
Figure 11A:
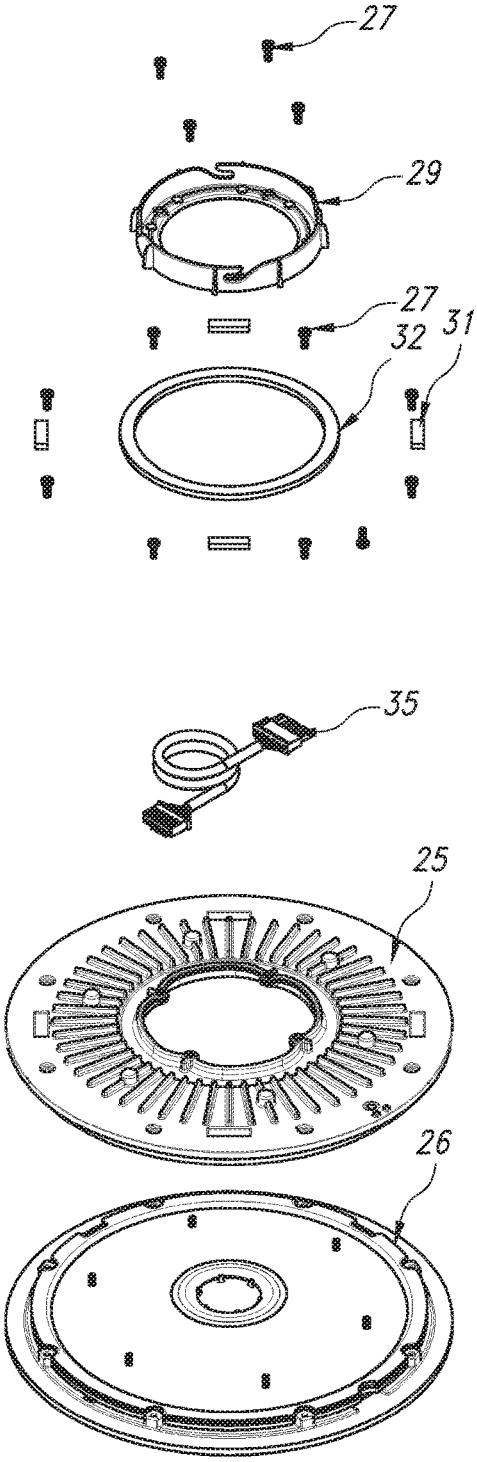

FIGS. 11 and 11A of an accessory according to another embodiment.

Figure 12:
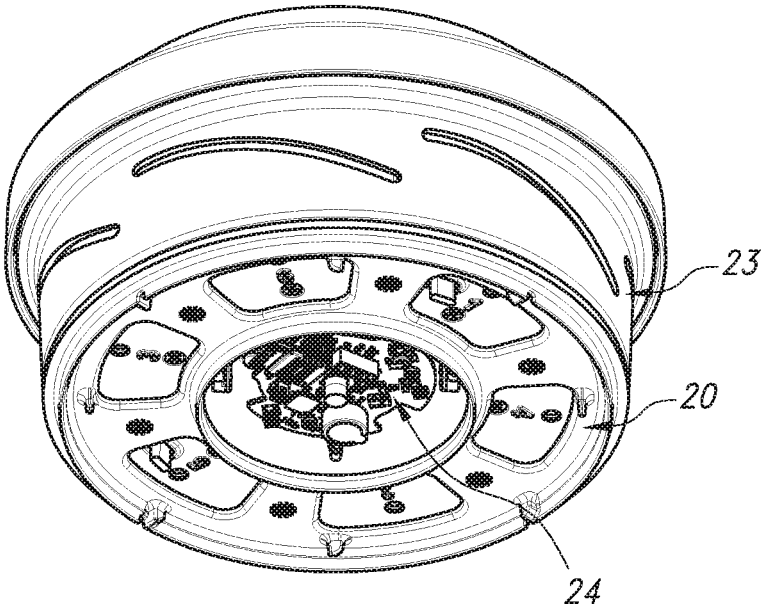
Figure 12A:
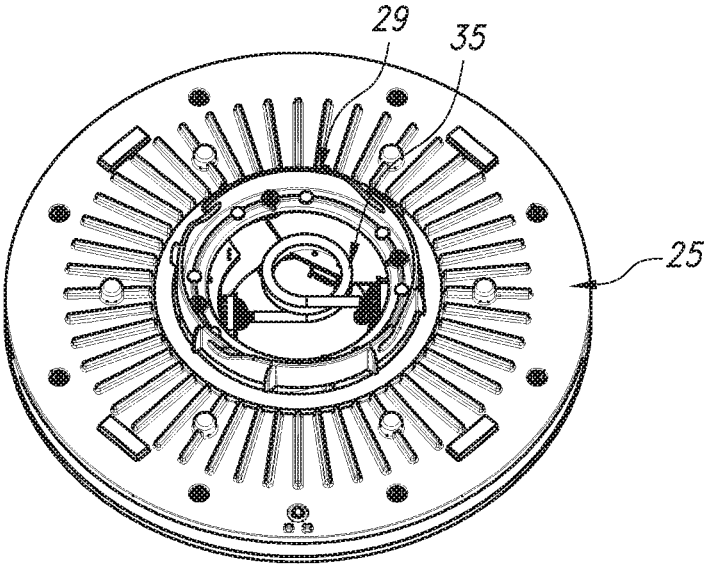

FIGS. 12 and 12A are views of yet another aspect of the disclosure.

The dimensions of some of the elements may be exaggerated relative to other elements for clarity or several physical components may be included in one functional block or element.

Further, sometimes reference numerals may be repeated among the drawings to indicate corresponding or analogous elements. Moreover, some of the items depicted in the drawings may be combined into a single function.

DETAILED DESCRIPTION

The following description of certain examples of the invention should not be used to limit the scope of the disclosure. Other examples, features, aspects, embodiments, and advantages of the invention will become apparent to those skilled in the art from the following description, which includes by way of illustration, one or more of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
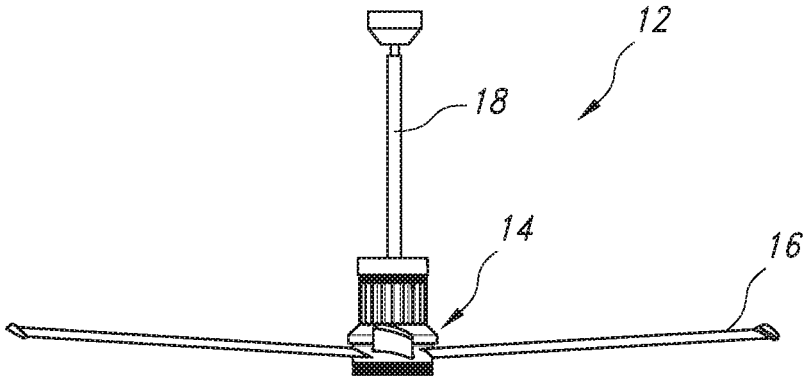
FIG. 1 is a side view of a ceiling fan in a mounted condition.
Figure 1A:
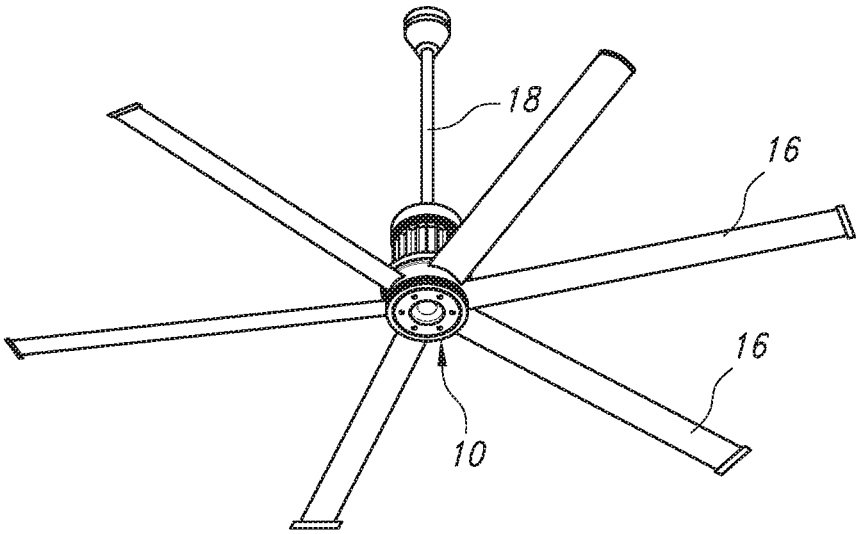
FIG. 1A is a bottom perspective view of the ceiling fan in an unmounted condition.

With reference to FIGS. 1 and 1A, an attachment system 10 for a ceiling fan 12 is proposed. As can be understood from FIG. 1, the ceiling fan 12 may include a hub 14 enclosing a motor (see FIG. 2). The hub 14 supports a plurality of fan blades 16, and is adapted for rotation as a result of actuator of the motor. The fan 12 may be suspended from a ceiling by a mount 18, as shown in FIG. 1A, but could also be mounted directly to the ceiling or another structure (such as a joist or beam).

Figure 2:
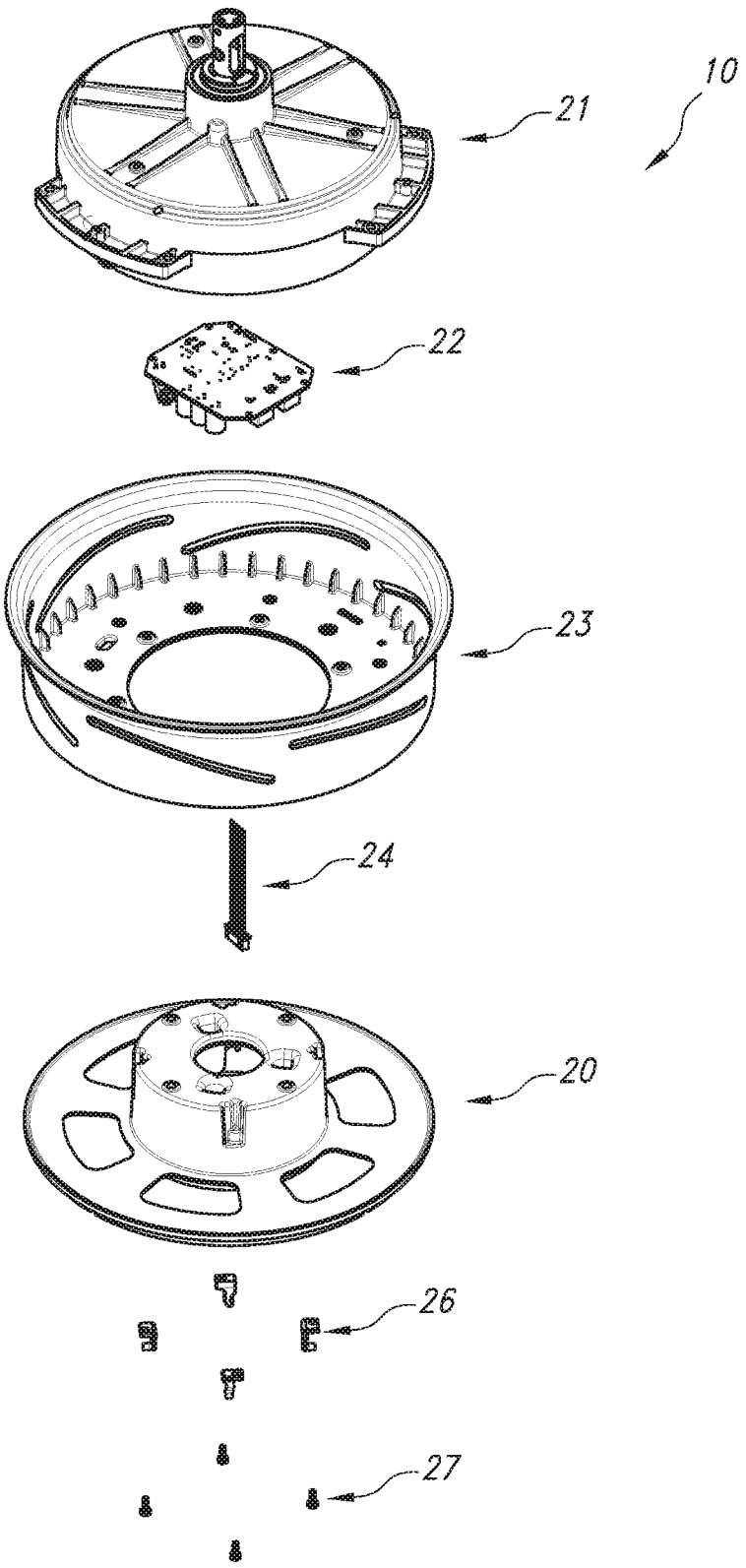
FIG. 2 is an exploded view of a ceiling fan accessory mounting system according to one aspect of the disclosure.

FIG. 2 shows a receiver 20 forming part of the attachment system 10. As can be seen, the fan 12 may internally include additional hardware, such as a motor 21 for rotating the hub 14, a motor controller, such as a PCB 22, a motor hub cover 23, a sensor board harness 24, and lastly the receiver 20. In the illustrated embodiment, the receiver 20 is shown as a male accessory adaptor, which may be partially inserted into and connected to the motor hub cover 23. The receiver 20 may include one or more retainers 26, which may then be used to retain the adaptor 29, as described herein.

FIG. 3 illustrates the receiver 20 in further detail. The receiver 20 may include a turret 20*a*, which may be attached to the motor 21. In practice, the turret 20*a* may be connected to the motor 21 in a factory setting, or otherwise prior to a consumer receiving the fan. Retainers 26, which are further illustrated in FIG. 4, may be attached to the receiver 20, such as via bosses 20*b* associated with the receiver 20. This attachment may be accomplished via one or more fasteners, such as socket head screws 27. The bosses 20*b* may be located within a cavity defined by the receiver 20. The retainers 26, once attached, may also be within the cavity of the receiver 20.

FIGS. 5 and 5A illustrate a first embodiment of the attachable fan accessory 30. As FIG. shows, the accessory 30 does not include a light, though as disclosed below, the attachable fan accessory may include a light or other electrical functional element. The accessory 30 may be pre-assembled prior to being provided to a customer, and may attach directly to the fan upon receipt.

The accessory 30 comprises an adaptor 29 for engaging the receiver 20. As also shown in FIG. 6, the adaptor 29 may comprise a projection or other male adapter element which may nest with the receiver 20 upon installation of the accessory 30. In another embodiment, the receiver 20 may comprise a projection, and the adaptor 29 may comprise a female element for engaging the receiver 20.

FIG. 6 illustrates one embodiment of the adaptor 29 in further detail. As shown, the adaptor 29 may comprise a round or annular shape, or any shape coordinating with a shape of the receiver 20, such that the adaptor 29 and receiver 20 may mate with each other in order to attach the accessory 30 to the fan. In one aspect, the adaptor 29 may include one or more connectors 29*a* adapted to releasably mate and connect with a portion of the receiver 20 in order to secure the accessory 30 to the fan. For example, the connector 29*a* may comprise an aperture, a cavity, or other recess adapted to slidably receive a projection 26*a* of retainer 26 (see FIG. 4).

The accessory 30 may further comprise a heatsink 25 and a lower cover 25*a*, to which the adaptor 29 may be attached, such as via retainer (e.g. socket head cap screws 27). The accessory may further include a dampener 31, which may be adapted for reducing vibrations of the accessory during use as outlined below. In another aspect, the accessory 30 may include a gasket 32 for sealing the motor from the elements as further outlined below. The accessory 30 may further include a detent, such as a spring pin 33 or other releasable fixing device, which may be used to secure the accessory into place as described herein.

FIG. 7 illustrates the heatsink 25 in further detail. The heatsink 25 may further include a spring pin cavity 25*c* adapted to provide a fixing location for the spring pin 33. A pair of spring pin tool access bosses 25*d* may be provided on the heatsink 25 for guiding a spring pin tool in order to release the accessory 30 from the fan 12.

FIGS. 8 and 8A illustrate one embodiment of a system for attaching the accessory 30 to the fan. FIG. 8 demonstrates the accessory 30 assembled and attached to the fan. This assembly may be accomplished by mating the receiver 20 of the fan 12 with the adaptor 29 of the accessory and locking it in place. For example, the adaptor 29 may be mated with the receiver 20 so that the projections 26*a* on the retainers 26 align with the connectors 29*a* on the adaptor 29. Upon mating of the adaptor 29 and the receiver 20, rotating the accessory 30 may guide the projections 26*a* into to place within the connectors 29*a*.

Once in place, the spring pin 33 may lock the accessory 30 into place. For example, the receiver 20 may include one or more spring pin bosses 20*d*. These bosses 20*d* may present a sloping geometry, thus allowing the spring pin 33 to compress as the accessory 30 turns one direction, but then prevent turning of the accessory in a reverse direction once the spring pin 33 has passed the boss 20*d*. This is illustrated in FIG. 8A, in which the sloping geometry of the boss 20*d* compresses the spring pin 33 as the accessory 30 is twisted into place. Once the spring pin 33 passes beyond the boss 20*d*, the spring pin 33 may spring back into place, and prevent the accessory 30 from being twisted off.

To remove the accessory 30, a spring pin tool may be inserted in an access gap 20*e* to compress the spring and allow the accessory to be twisted in a reverse direction and removed. This access gap 20*e* in the receiver 20 may be adapted to align between bosses 25*d* of the heatsink 25 when fully assembled, thus guiding a user in a specific point to insert the spring pin tool.

With further reference to FIG. 7, one or more dampener receivers 25*a* may be provided on the heatsink 25 for affixing or mounting the dampener 31. In one aspect, four such receivers 25*a* may be provided such that four dampeners 31 may be affixed in order to provide symmetric dampening of movement of the accessory 30 with respect to the fan. As can be seen in FIG. 9, these dampeners 31 may each contact a projection, such as a vibrational damper boss 20*c* on the receiver 20, once the accessory 30 is in place. The dampener 31 may be a resilient material such as rubber, plastic, foam, or other pliable or elastic material. Accordingly, contact between the dampener 31 and the boss 20*c* may prevent the accessory 30 from rattling or vibrating excessively when the fan is running.

Turning back to FIG. 7, a gasket receiver 25*b* may be provided in the heatsink 25 for affixing the gasket 32. FIG. 10 illustrates the assembled accessory 30 and fan 12, and shows the gasket 32 within the gasket receiver 25*b*. When assembled, the gasket 32 may engage a projection on the receiver 20 such as a seal boss 20*f*. The seal boss 20*f* may be similar in shape to the gasket 32.

Both the gasket 31 and the seal boss 20*f* may surround a perimeter of the receiver 20 or a perimeter of a portion of the receiver such that upon assembly, contact between the gasket 32 and the seal boss 20*f* may form a perimeter seal around at least a portion of the motor 21 and/or the motor controller 22. This contact between the gasket 32 and the seal boss 20*f* may prevent water or debris from entering the fan and damaging internal components, such as the motor 21, thus allowing use of the fan 12 and accessory 30 in indoor or outdoor conditions.

A second embodiment of a fan accessory attachment system is illustrated in FIG. 11, in which the fan accessory 50 includes an electrical functional element. In the illustrated embodiment, the electrical functional element is in the form of a light, but could include any number of electrical elements, such as a speaker, a sensor, a camera, or other electrically powered accessory. The fan accessory 50 with an electrical functional element (hereinafter generically referred to as an "accessory") includes similar elements to those discussed above with respect to the accessory 30. The accessory 50 may further include wiring for powering the electrical functional element, such as an electrical harness 35, as well as the electrical functional element itself, such as lower light components, in addition to the components of the accessory 50.

As is better demonstrated in FIGS. 12 and 12A, the accessory 50 houses its own electronic components, such as for the production of light or detection of motion or occupancy, and therefore needs the electrical harness 35 to connect it to the fan circuitry. To accomplish, and for ease of installation, the electrical harness 35 is provided in the form of a coiled harness attached to the light accessory. The electrical harness 35 may be long enough to be connected to the sensor board harness 24 easily. The coiled configuration allows the electrical harness 35 to coil in on itself when the accessory 50 is twisted and locked into place as described above with respect to FIGS. 8 and 8A, to prevent the electrical harness from getting caught or pinched in other components.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," or "approximately," as used herein referring to a measurable value, such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform as disclosed. However, it is to be understood that the value to which any modifier, such as "about," refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Although the invention has been described in conjunction with specific embodiments, many alternatives, modifications, and variations will be apparent to those skilled in the art. Accordingly, it embraces all such alternatives, modifications, and variations that fall within the appended claims' spirit and scope. All publications, patents and patent applications mentioned in this specification are herein incorporated in their entirety by reference into the specification, to the same extent as if each individual publication, patent or patent application was specifically and individually indicated to be incorporated herein by reference. In addition, or identification of any reference in this application shall not be construed as an admission that such reference is available as prior art to the present disclosure.

The invention claimed is:

1. An apparatus, comprising:

a ceiling fan including a motor hub cover with at least one aperture;

an accessory;

a receiver including a turret adapted to insert at least partially through the aperture in the motor hub cover to attach the receiver to the ceiling fan;

an adaptor for the accessory, the adaptor adapted to releasably attach to the receiver and fix the accessory in position with respect to the ceiling fan;

a coiled electrical harness for connecting the accessory to the ceiling fan; and a dampener connected to the accessory;

wherein the receiver is adapted to receive the accessory and connect with the ceiling fan, the receiver including at least one projection adapted to engage the dampener along an outer surface of the at least one projection, thereby inhibiting vibration of the accessory during operation of the ceiling fan.

2. The apparatus of claim 1, wherein the adaptor is adapted to mate with the receiver via a rotational movement of the accessory.

3. The apparatus of claim 1, wherein the receiver comprises at least one projection, and the adaptor comprises at least one receiving connector for receiving the projection.

4. The apparatus of claim 1, further including a detent adapted to lock the accessory in position with respect to the receiver.

5. The apparatus of claim 4, wherein the detent comprises a spring pin, and further including a boss adapted to allow movement of the spring pin in a first direction to a first position and to prevent movement of the spring pin in a second direction beyond the first position.

6. The apparatus of claim 1, wherein the accessory comprises an electrically functional element.

7. An apparatus, comprising;

a ceiling fan;

an accessory;

a dampener connected to the accessory; and a receiver adapted to receive the accessory and connect with the ceiling fan, the receiver including at least one projection adapted to engage the dampener along an outer surface of the at least one projection, thereby inhibiting vibration of the accessory during operation of the ceiling fan.

8. The apparatus of claim 7, wherein the accessory comprises an electrically functional element.

9. The apparatus of claim 8, wherein the electrically functional element is selected from the group consisting of a speaker, a sensor, and a camera.

10. The apparatus of claim 7, further including a coiled electrical harness for connecting the accessory to the ceiling fan.

11. The apparatus of claim 7, further including a detent adapted to lock the accessory in position with respect to the ceiling fan.

12. The apparatus of claim 11, wherein the detent comprises a spring pin, and further including a boss adapted to allow movement of the spring pin in a first direction to a first position and to prevent movement of the spring pin in a second direction beyond the first position.

13. An apparatus, comprising:

a ceiling fan including a motor and a motor hub cover;

an accessory including a gasket, an electrically functional element, and an electrical harness adapted to connect to the ceiling fan;

a receiver adapted for insertion at least partially through the motor hub cover, the receiver further adapted to receive the accessory, wherein the receiver includes at least one first projection adapted to engage the gasket, thereby at least partially sealing the motor from an environment external to the ceiling fan; and a dampener connected to the accessory;

wherein the receiver is further adapted to connect with the ceiling fan, the receiver including at least one second projection adapted to engage the dampener along an outer surface of the at least one second projection, thereby inhibiting vibration of the accessory during operation of the ceiling fan.

14. The apparatus of claim 13, wherein the gasket and the at least one first projection form a perimeter seal around at least a portion of the motor.

15. The apparatus of claim 13, wherein the electrically functional element is selected from the group consisting of a speaker, a sensor, and a camera.

* * * * *